US006328605B1

(12) United States Patent
Walker et al.

(10) Patent No.: US 6,328,605 B1
(45) Date of Patent: Dec. 11, 2001

(54) ELECTRICAL CONNECTOR FOR RECEIVING MODULE CARDS AND AN OPERATING CIRCUIT CARD

(75) Inventors: Kevin E. Walker, Hershey; David A. Trout, Wrightsville; William E. Spink, Jr., Harrisburg, all of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/350,348

(22) Filed: Jul. 14, 1999

(51) Int. Cl.[7] ..... H01R 9/09

(52) U.S. Cl. ..... 439/631; 439/630; 439/59; 439/61

(58) Field of Search ..... 439/630, 631, 439/632, 633, 634, 635, 636, 326, 59, 61, 62, 328, 329

(56) References Cited

U.S. PATENT DOCUMENTS 3,932,016 * 1/1976 Ammenheuser ..... 339/65
3,955,875 * 5/1976 Petiot ..... 339/176
4,223,968 * 9/1980 Kawabata et al. ..... 339/14
4,623,207 * 11/1986 Sasaki et al. ..... 339/17
4,747,790 * 5/1988 Masuda et al. ..... 439/631
5,876,214 * 3/1999 McHugh et al. ..... 439/60
6,053,757 * 4/2000 Turnbull ..... 439/326

* cited by examiner

*Primary Examiner*—Gary Paumen
*Assistant Examiner*—Alexander Gilman

(57) ABSTRACT

An electrical connector for electrical connection to a circuit board (12) and for receiving a module card (16) and an operating circuit card (14) comprises a dielectric housing (24) having adjacent card-receiving areas (26, 28), first electrical contacts (18, 20) mounted in the dielectric housing and having termination sections **(18*c*, 20*c*) for electrical connection with conductive members of the circuit board and contact sections (18*a*, 20*a*) extending into one of the card-receiving areas (28) for electrical connection to conductive members of the module card (16) when inserted into the one of the card-receiving areas, and second electrical contacts (22) mounted in the dielectric housing and having contact portions (22*b*) extending into the one of the card-receiving areas (28) for electrical connection with conductive members of the module card (16) and extending into the other of the card-receiving areas (26) for electrical connection with conductive members on the operating circuit card (14) when inserted into the other of the card-receiving areas (26)**.

13 Claims, 6 Drawing Sheets

ELECTRICAL CONNECTOR FOR RECEIVING MODULE CARDS AND AN OPERATING CIRCUIT CARD

FIELD OF THE INVENTION

The present invention relates to circuit board connectors and more particularly to circuit board connectors along which module cards are received and electrically connected to electrical contacts thereof and to an operating circuit card.

BACKGROUND OF THE INVENTION

The conventional solution to allow computer equipment to remain in continuous operation has been to add electronic switches to motherboard circuitry. These switches allow adapter cards that contain processors, memory or I/O ports, to be added or replaced without the need to turn power off to the equipment.

Motherboard circuit designers have been faced with the problem of designing circuitry that incorporates these switches in a manner that does not affect the electrical signal integrity and performance of the adapter cards. Variations in circuit design from one circuit design to another may be significant enough to cause certain adapter cards to operate improperly.

Therefore it would be beneficial to transfer the switch capability off the motherboard and place it into the adapter connector component. This will allow for uniform circuit design as well as minimal circuit path length to be utilized. It will also allow equipment manufacturers to incorporate desired switch technology without extensive motherboard circuitry design and development.

SUMMARY OF THE INVENTION

An important feature of the present invention is to provide an electrical connector along which module cards are received and electrically connected to electrical contacts thereof and electrically connected to operating circuit cards inserted into the electrical connector.

The present invention is directed to an electrical connector for electrical connection to a circuit board and for receiving a module card and an operating circuit card comprising a dielectric housing having adjacent card-receiving areas, first electrical contacts mounted in the dielectric housing and having termination sections for electrical connection with conductive members of the circuit board and contact sections extending into one of the card-receiving areas for electrical connection to first conductive members on the module card when disposed along the one of the card-receiving areas, and second electrical contacts mounted in the dielectric housing and having contact portions extending into the one of the card-receiving areas for electrical connection with second conductive members on the module card and extending into the other of the card-receiving areas for electrical connection with conductive members on the operating circuit card when disposed along the other of the card-receiving areas.

BRIEF DESCRIPTION OF THE DRAWINGS

Embodiments of the present invention will now be described by way of example with reference to the accompanying drawings in which.

DETAILED DESCRIPTION OF THE INVENTION

Figure 1:
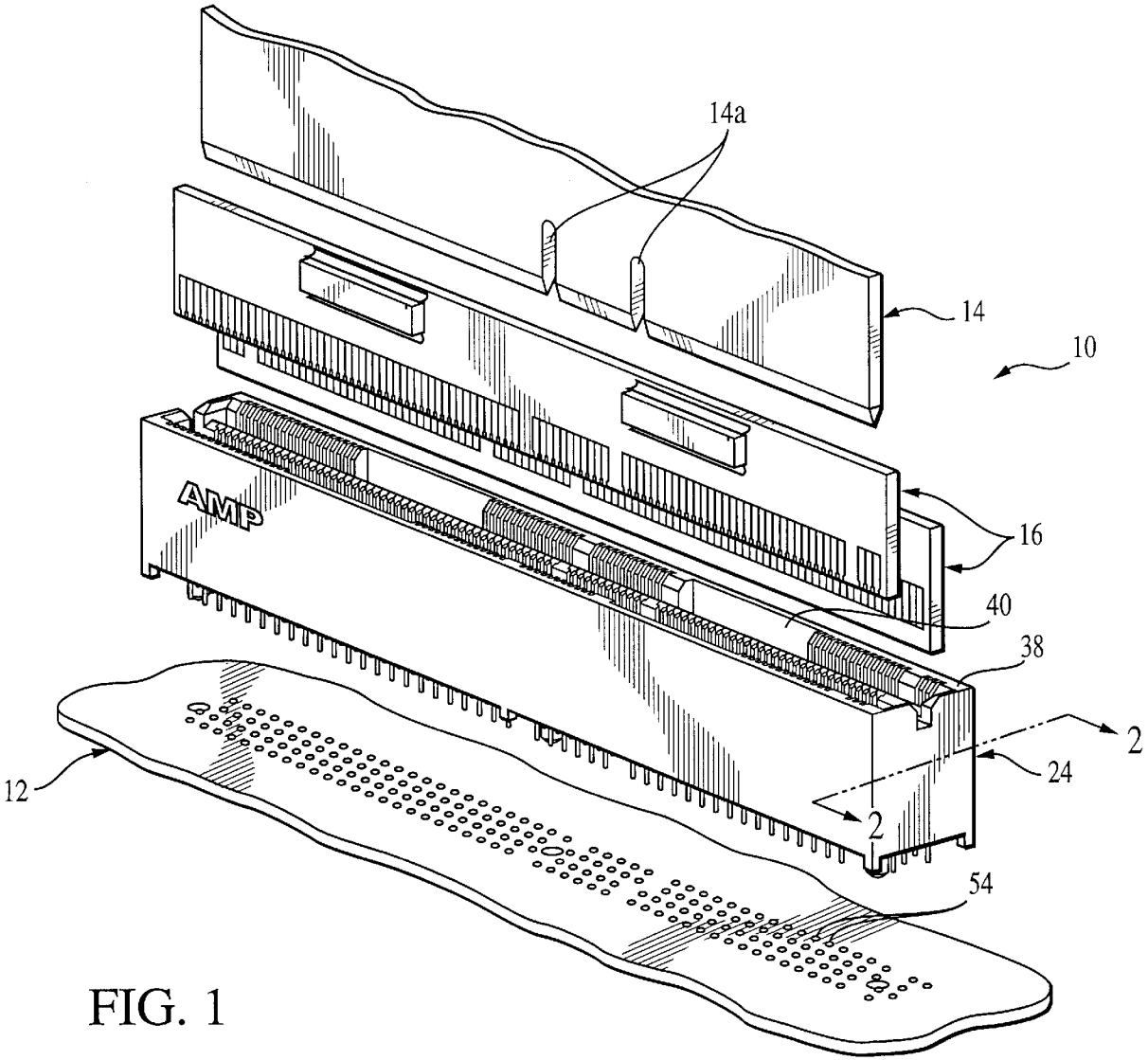
FIG. 1 is an exploded perspective view of an electrical connector of the present invention with an operating circuit card and module cards to be received within the electrical connector exploded therefrom and the electrical connector exploded from a mother board.
Figure 2:
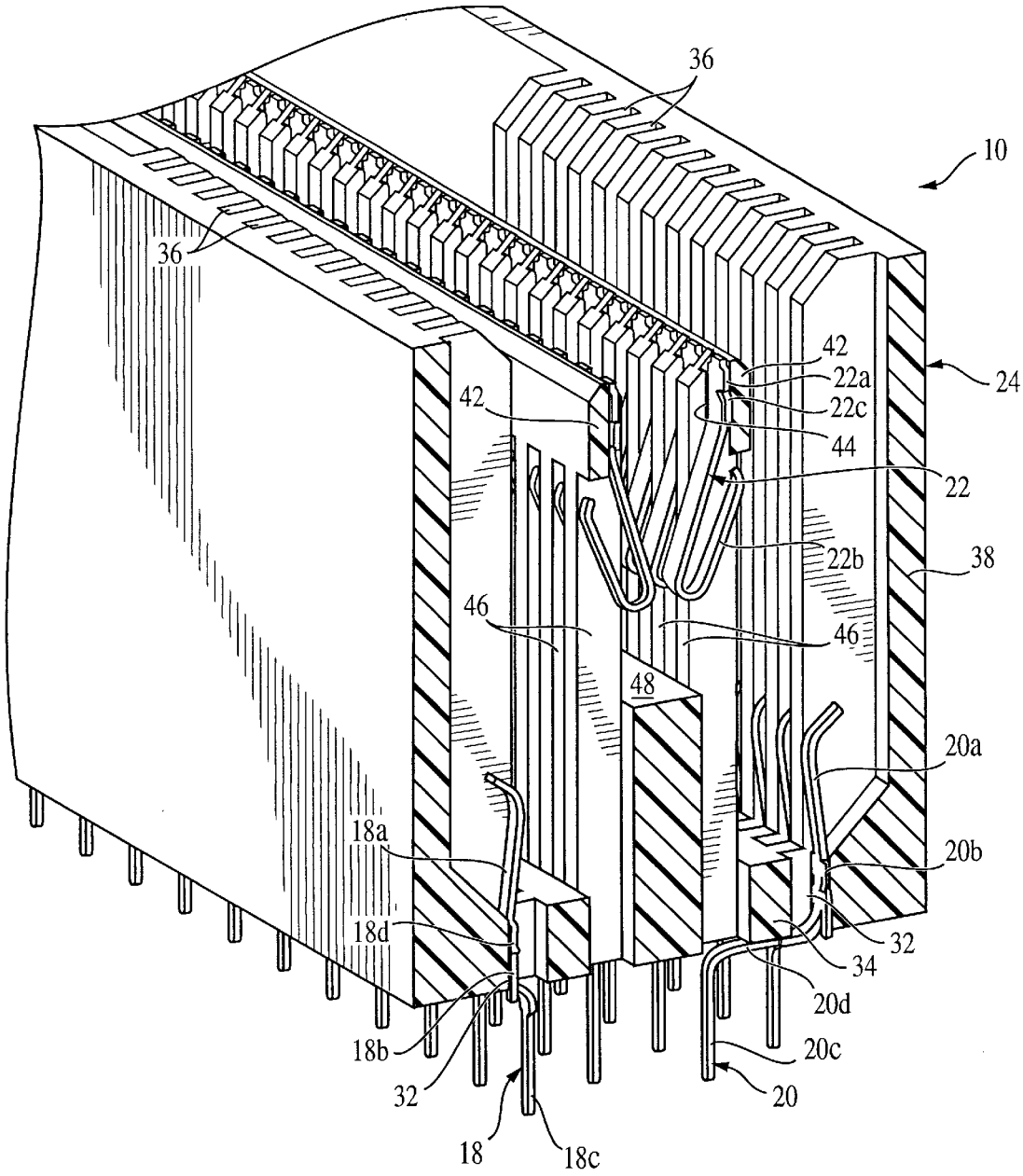
FIG. 2 is a part perspective view in cross section taken along line 2—2 of FIG. 1.
Figure 3:
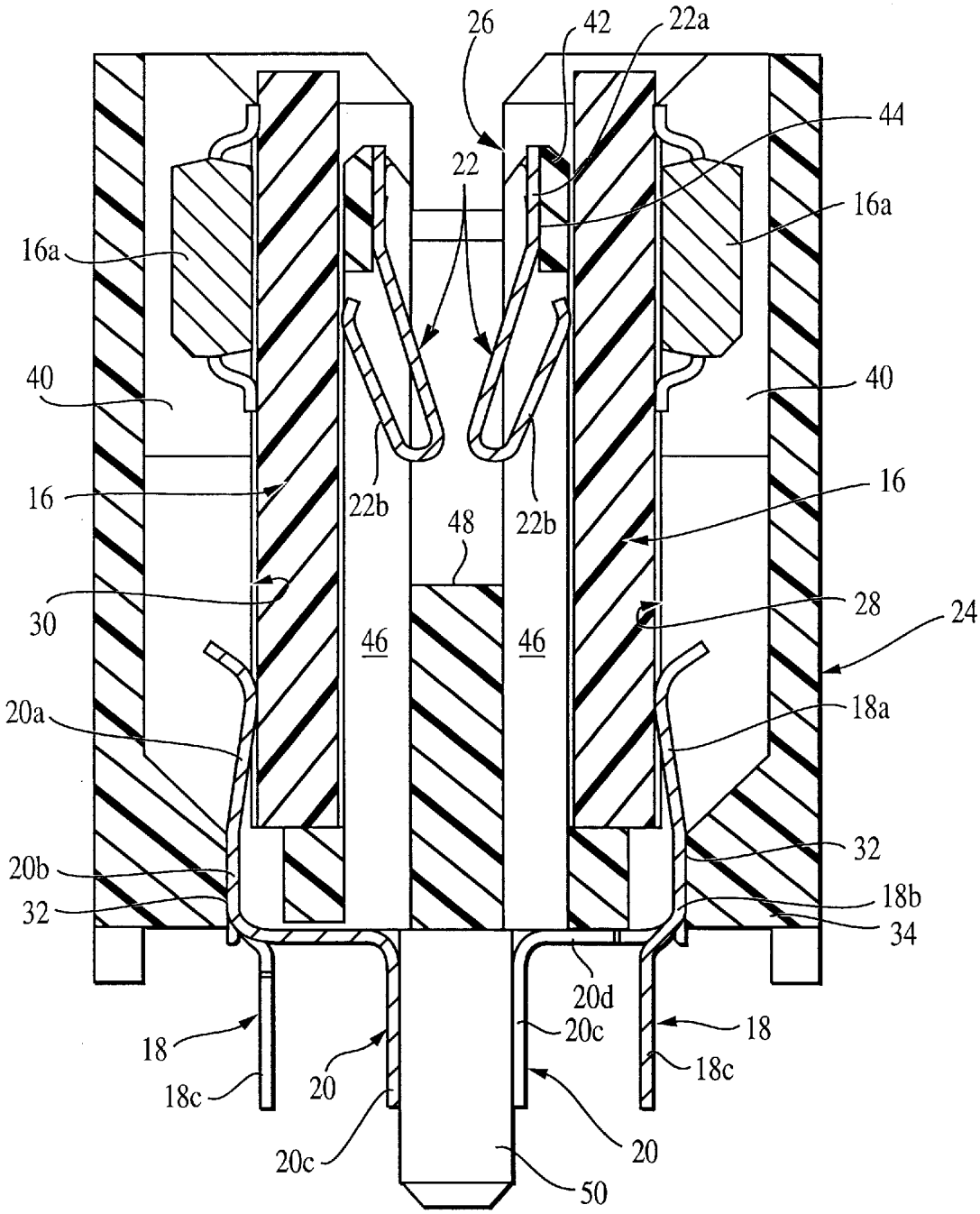
FIG. 3 is a cross-sectional view of the electrical connector of FIG. 1 with the module cards in position in the electrical connector.

As shown in FIGS. 1–3, electrical connector 10 is to be electrically connected to mother board 12, and operating circuit card 14 and module cards 16 are to be received by electrical connector 10 and electrically connected to electrical contacts 18, 20, 22 mounted in dielectric housing 24 of the electrical connector 10.

Mother board 12 is part of a server (not shown) and has electronic circuits thereon and several electrical connectors serving to process electronic data between various electronic equipment as part of a PCI network. The operating circuit card 14 is a PCI card that is inserted into electrical connector 10 and it is electrically connected to module cards 16 via electrical contacts 22 and module cards 16 are electrically connected to mother board 12 via electrical contacts 18, 20; module cards 16 have electronic switches for controlling the operation of operating circuit card 14.

Housing 24 of electrical connector 10 is molded from a suitable dielectric material and it includes adjacent cavities or card-receiving areas 26, 28, 30 along which the operating circuit card 14 is received and module cards 16 are disposed. A row of rectangular apertures 32 extend through a bottom wall 34 of housing 24 along each side thereof and they are in communication with respective recesses 36 disposed in each side wall 38 of housing 24. Several pockets 40 are located along each of the side walls 38 opposite each other and the side walls forming recesses 36 at the location of pockets 40 terminate about midway of side walls 38. Spaced inner walls 42 of housing 24 form cavity 26 and they have rectangular slots 44 that communicate with elongated slots 46 that extend through the bottom wall 34. The outer walls of the inner walls 42 form respectively the inner walls of cavities 28, 30. A bottom surface 48 is located in cavity 26. The upper inner surfaces of the side walls 38 and the upper inner and outer surfaces of inner walls 42 are tapered inwardly. Posts 50 extend outwardly from an outer surface of bottom wall 34 for disposition in respective holes 52 in the mother board 12 adjacent both ends and in the middle of plated-through holes 54 in the mother board constituting the foot print for connector 10 thereon.

Electrical contacts 18, 20, 22 are stamped and formed from a suitable metal sheet having the desired electrical and spring characteristics. The electrical contacts are preferably stamped and formed in strip form so that they can automatically be inserted into their respective slots 32, 44 in housing 24 while being simultaneously sheared from their respective metal strips.

Electrical contacts 18 have contact sections 18*a*, securing sections 18*b* and termination sections 18*c*, and they are secured in every other aperture 32 in each of the rows of rectangular apertures 32. Contact sections 18*a* extend from planar securing sections 18*b* as cantilever contact sections and they are disposed in respective recesses 36 in side walls 38. Outer ends of contact sections 18*a* are arcuate with free ends being disposed within the recesses 36 and arcuate contact sections extending into the cavities 28, 30. Securing sections 18*b* have barbs 18*d* extending outwardly from each side thereof and they bite into opposing walls of rectangular apertures 32 thereby securing electrical contacts 18 therewithin in a stable manner. Termination sections 18*c* are generally square posts and they extend outwardly from the bottom wall 34.

Electrical contacts 20 have contact sections 20*a,* securing sections 20*b* and termination sections 20*c,* and they are disposed in every other rectangular aperture 32 in each of the aperture rows 32. Contact sections 20*a* and securing sections 20*b* are identical in structure to contact sections 18*a* and securing sections 18*b,* whereas termination sections 20*c* have horizontal sections 20*d* extending inwardly along bottom wall 34 which then become generally square posts that extend vertically outwardly from the bottom wall. Thus, termination sections 18*c* of electrical contacts 18 are aligned in outer rows whereas termination sections 20*c* are aligned in inner rows on each side of a central plane of electrical connector 10 as best shown in FIG. 3.

Electrical contacts 22 have securing portions 22*a* and generally U-shaped contact portions 22*b*. Securing portions 22*a* are planar and they have barbs 22*c* extending outwardly from each side thereof biting into the opposing walls of the rectangular slots 44 thereby stably securing the electrical contacts 22 therein. U-shaped contact portions 22*b* extend outwardly from planar securing portions 22*a* and extend along respective elongated slots 46. The bights of the U-shaped contact portions extend into cavity 26 constituting arcuate contact portions whereas free ends of the U-shaped contact portions are arcuate free end contact portions that extend respectively into cavities 28, 30.

Module cards 16 have conventional C-MOS electronic switch components 16*a* surface mounted on outer surfaces thereof and they have a row of conductive pads (not shown) adjacent a bottom edge below the components 16*a* that are electrically connected with contact sections 18*a,* 20*a* of electrical contacts 18, 20 when the module cards are inserted into cavities or card-receiving areas 28, 30. A row of conductive pads (not shown) are disposed along an opposite surface of module cards 16 that are electrically connected with the arcuate free end contact portions of the U-shaped contact portions 22*b*. The arcuate contact portions of the U-shaped contact portions 22*b* electrically engage the conductive pads on the operating circuit card 14 when it is inserted into cavity 26. The resilient contact sections 18*a,* 20*a* and resilient U-shaped contact portions 22*b* wipingly engage the respective conductive pads on module cards 16 and operating circuit card 14 thereby providing an optimum electrical connection therebetween. Operating circuit card 14 has recesses 14*a* that mates with projections (not shown) in housing 24 to make certain that the proper operating circuit card is used.

Latches can be provided by housing 24 and the module cards 16 to latch the module cards within the housing. The latches can be resilient latch members on the module cards that engage latch surfaces in the housing.

Figure 4:
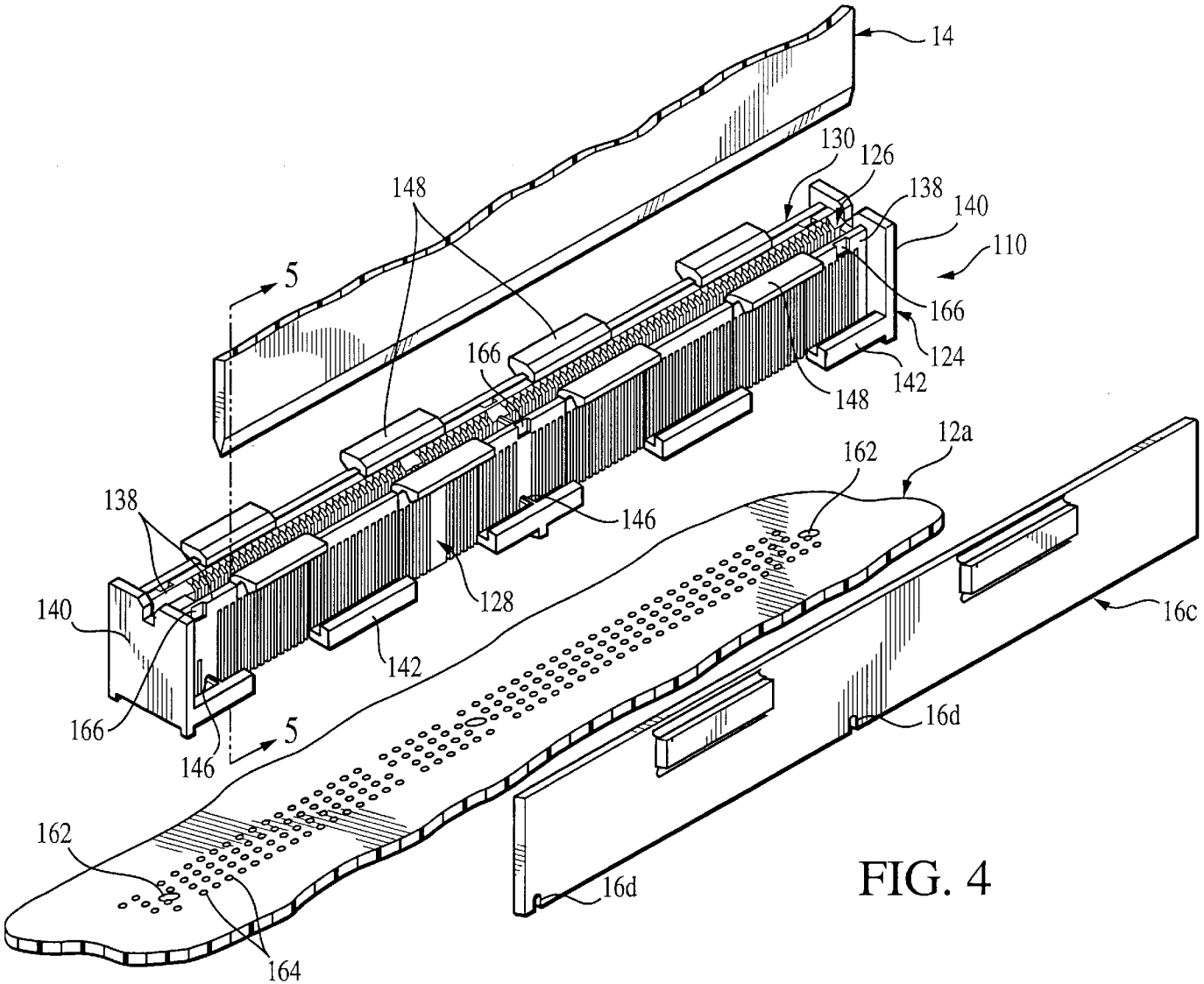
FIG. 4 is an exploded perspective view of an alternative embodiment of an electrical connector of the present invention.
Figure 5:
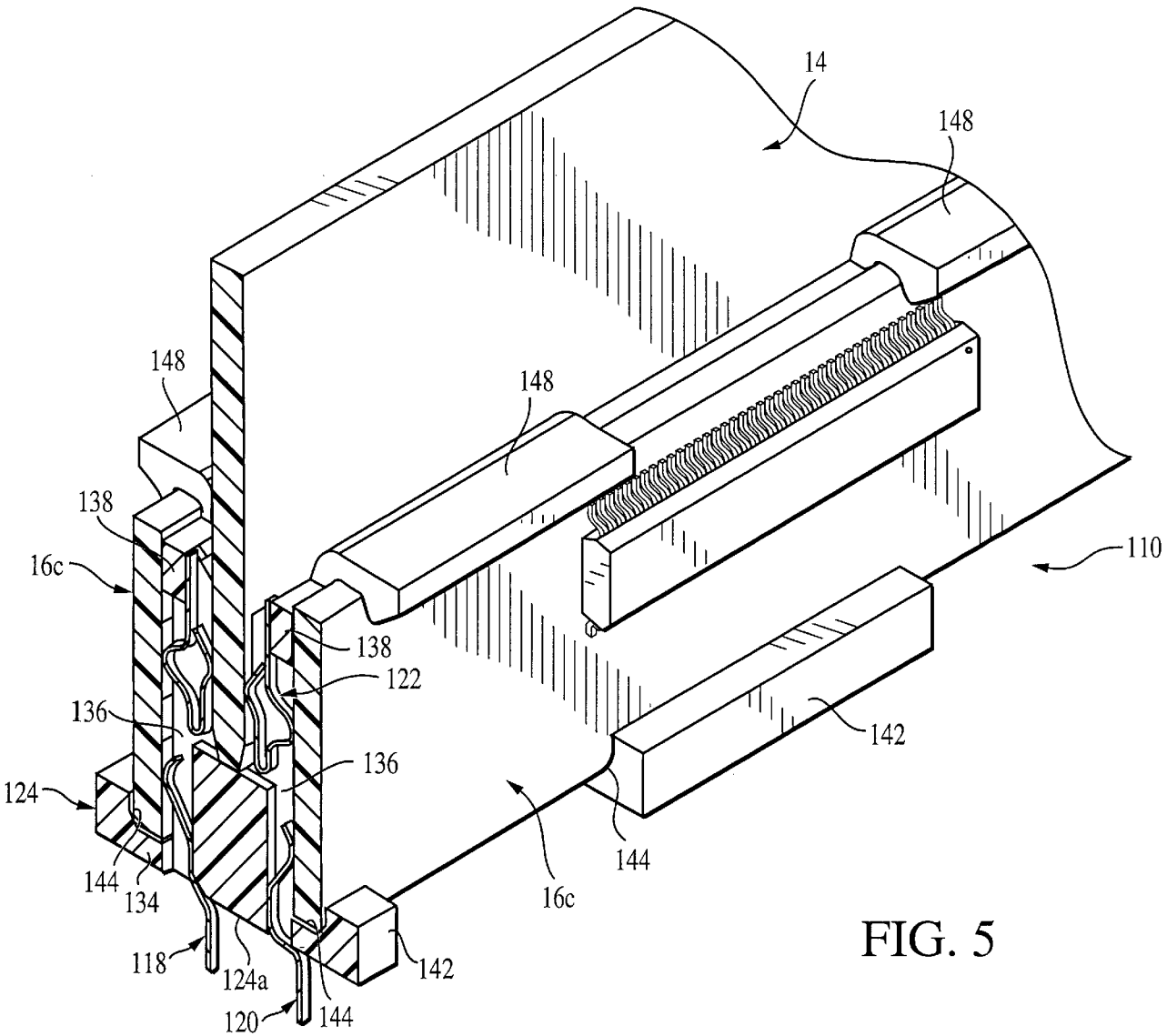
FIG. 5 is a part perspective view in cross section taken along line 5—5 of FIG. 4.
Figure 6:
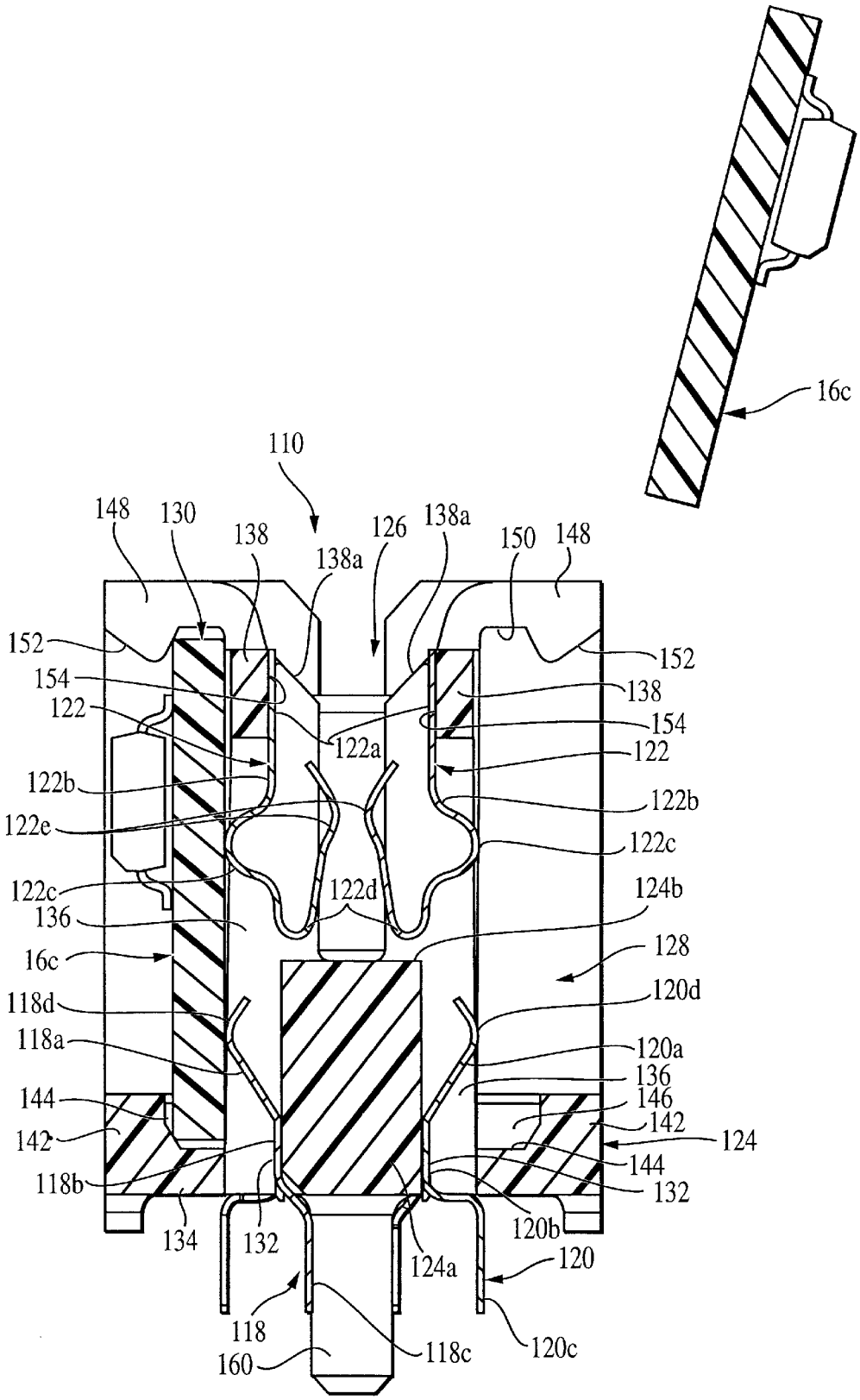
FIG. 6 is a cross-sectional view of the electrical connector of FIG. 4 with one of the module cards in position on the electrical connector and another of the module cards exploded therefrom.

FIGS. 4–6 show an alternative embodiment of electrical connector 110 that is to be electrically connected to motherboard 12*a,* and operating circuit card 14 and module cards 16*c* are to be received by electrical connector 110 and electrically connected to electrical contacts 118, 120, 122 mounted in dielectric housing 124 of the electrical connector 110.

Housing 124 of electrical connector 110 is molded from a suitable dielectric material, and it includes adjacent card-receiving areas 126, 128, 130 along which the operating circuit card 14 is received and module cards 16*c* are disposed. A row of rectangular apertures 132 extend through a bottom wall 134 of housing 124 along each side thereof, and they are in communication with respective rectangular slots 136 in each side wall of 138 of housing 124. End walls 140 are located at the ends of side walls 138.

Extensions 142 extend outwardly from bottom ends of side walls 138 at spaced locations therealong, and they have recesses 144 therein for receiving bottom ends of module cards 16*a* therein. The outer surfaces of recesses 144 are inclined from about midway thereof to the bottom surfaces of the recesses to accommodate varying thicknesses of module cards 16*c*. Projections 146 are located in selected extensions 142 within recesses 144, and they serve as polarizing projections for recesses 16*d* in module cards 16*c* to make certain that the proper module card is being positioned in the respective card-receiving area.

Flexible latch members 148 extend outwardly from upper ends of the side walls 138, and they are spaced therealong so as to be positioned within the spaces between extensions 142; thus, extensions 142 and latch members 148 are staggered along each of side walls 138. Latch members 148 have recesses 150 with outer surfaces thereof being inclined to accommodate varying thicknesses of module cards 16*c*. Tapered surfaces 152 are provided at the front ends of latch members 148 and they function as camming surfaces for engagement by upper ends of the module cards 16*c* to move the latch members upwardly thereby enabling the upper ends of the module cards to be positioned in recesses 150 and latching the module cards within the card-receiving areas 128, 130 by latch members 148 along respective sides of electrical connector 110 as shown in FIG. 5.

A rectangular section 124*a* extends between end walls 140 and an upper surface 124*b* thereof is a bottom surface for card-receiving area 126. The upper ends of the side walls 138 have tapered inner surfaces 138*a*.

Electrical contacts 118, 120, 122 are stamped and formed from a suitable metal sheet having the desired electrical and spring characteristics, and they are preferably stamped and formed in strip form so that they can be inserted into their respective rectangular apertures 132, 154 in housing 124. Apertures 132 in which electrical contacts 118, 120 are secured are in alignment with respective apertures 154 in each of the side walls 138 and apertures 132, 154 are in communication with rectangular slots 136.

Electrical contacts 118 have contact sections 118*a,* securing sections 118*b* and termination sections 118*c,* and they are secured in every other aperture 132 in each of the rows of rectangular apertures 132. Electrical contacts 118 are similar to electrical contacts 18, and contact sections 118*a* extend along bottom sections of slots 136 and side walls of rectangular section 124*a* with arcuate contact sections 118*d* extending into card-receiving areas 128, 130 for electrical connection with respective conductive pads on the module cards 16*a*.

Electrical contacts 120 have contact sections 120*a,* securing sections 120*b* and termination sections 120*c,* and they are secured in every other rectangular aperture 132 in each of the rows of rectangular apertures 132. Electrical contacts

120 are similar to electrical contacts 20. Thus, termination sections 118*c* of electrical contacts 118 are aligned in inner rows whereas termination sections 120*c* of electrical contacts 120 are aligned in outer rows on each side of a central plane of electrical connector 110 as shown in FIG. 6. Contact sections 120*a* also extend along the bottom sections of the slots 136 and the side walls of rectangular section 124*a* with arcuate contact sections 120*d* extending into card-receiving areas 128, 130 for electrical connection with respective lower conductive pads on the module cards 16*c*.

Electrical contacts 122 have securing portions 122*a* and contact portions 122*b*. Securing portions 122*a* are planar and they have barbs (not shown) extending outwardly from each side thereof biting into the opposing walls of the rectangular slots 154 thereby stably securing the electrical contacts 122 therein. Contact portions 122*b* extend outwardly from the planar securing portions 122*a* and along upper sections of the slots 136, and they have first arcuate contact portions 122*c* that extend into respective card-receiving areas 128, 130, bight portions 122*d* and second arcuate contact portions 122*e* at free ends that extend into card-receiving area 126 from opposing sides thereof. The free ends are normally located within slots 136. First arcuate contact portions 122*c* electrically engage with respective upper conductive pads on module cards 16*c*, whereas second arcuate contact portions 122*e* electrically engage with respective conductive pads on opposing surfaces of the operating circuit card 14.

Posts 160 extend outwardly from a bottom surface of rectangular section 124*a* for disposition in holes 152 in motherboard 12*a* and termination sections 118*c*, 120*c* of electrical contacts 118, 120 are positioned in plated-through holes 164 in motherboard 12*a* and soldered thereto when the electrical connector 110 is mounted onto and electrically connected to the motherboard.

The components are mounted onto outside surfaces of the module cards, and electrical connections by the electrical contacts 118, 120, 122 to the conductive pads on the module cards are made on inside surfaces of the module cards. Recesses 166 are located at upper ends of the side walls 138 at spaced locations in which a tool is positioned to pry loose the module cards from the latch members 148. Since the module cards are completely open on the component side, this will enable good ventilation thereof. The configuration of the contact portions 122*b* of the electrical contacts 122 provides normal contact force by the first arcuate contact portions 122*c* and the second arcuate contact portions 122*e*.

The present invention therefore allows the electronic switches and other electronic components to be removed from the mother board and formulated as module cards that are part of the electrical connector in which the operating circuit card is received. This enables hot-swap capability inside the electrical connector without powering down the server system.

Advantages of the present invention are: hot-swap capabilities in kit form can be offered without extensive system development; the module cards contain the electronic switches and other electronic components that characterize the hot-swap performance, thus since the module cards are inserted into a separate section of the electrical connector, the module cards can be replaced without any rework to the electrical connector or mother board thereby permitting easy replacement of defective electronic switches or use other module cards; module card design will permit custom module card layouts to be easily incorporated because system designers may prefer to develop their own module card circuitry for their specific applications, this would allow a system designed with a proprietary circuit design to incorporate the circuit design without exposing it to the connector supplier; a non hot-swap version would utilize blank module cards not containing electronic switches, however, the blank module cards could be replaced with electronic switch module cards allowing for upgrading of the PCI connectors to hot-swap capability; the seated height of the present connector is the same as a conventional PCI connector; the present connector uses substantially the same footprint as that of the conventional PCI connector.

What is claimed is:

1. An electrical connector for electrical connection to a circuit board and for receiving a module card and an operating circuit card comprising:

a dielectric housing having adjacent card-receiving areas;

first electrical contacts mounted in the dielectric housing and having termination sections for electrical connection with conductive members of the circuit board and contact sections extending into one of the card-receiving areas for electrical connection to conductive members of the module card when inserted into the one of the card-receiving areas;

second electrical contacts mounted in the dielectric housing and having contact portions extending into the one of the card-receiving areas for electrical connection with conductive members of the module card and extending into the other of the card-receiving areas for electrical connection with conductive members on the operating circuit card when inserted into the other of the card-receiving areas;

wherein the contact sections and the contact portions electrically engage the conductive members on the same side of the module card.

2. An electrical connector as claimed in claim 1, wherein the contact sections are cantilever contact members.

3. An electrical connector as claimed in claim 1, wherein every other one of the termination sections extend directly outwardly from a bottom wall of the dielectric housing and every other one of the termination sections include horizontal sections extending along the bottom wall and vertical sections extending outwardly from the bottom wall.

4. An electrical connector as claimed in claim 1, wherein the contact portions are U-shaped.

5. An electrical connector as claimed in claim 4, wherein arcuate contact portions extend into the one of the card-receiving areas and arcuate free end contact portions extend into the other of the card-receiving areas.

6. An electrical connector as claimed in claim 1, wherein the card-receiving areas are cavities.

7. An electrical connector as claimed in claim 1, wherein the housing includes side walls, extensions extending outwardly from bottom ends of the side walls and having recesses therein for receiving a bottom end of the module card, and flexible latch members extending outwardly from upper ends of the side walls for latching engagement with an upper end of the module card.

8. An electrical connector as claimed in claim 1, wherein the contact portions have first arcuate contact portions extending into the one of the card-receiving areas and second arcuate contact portions extending into the other of the card-receiving areas.

9. An electrical connector as claimed in claim 8, wherein bight portions are disposed between the first arcuate contact portions and the second arcuate contact portions.

10. An electrical connector for mounting to a circuit board and for receiving an operating circuit card and a module card, the electrical connector comprising:

a housing having a top surface and an oppositely facing base surface, the base surface positioned proximate to and parallel to the circuit board, a module card receiving area, and an operating circuit card receiving area extending from the top surface toward the base surface;

first electrical contacts mounted in the housing and extending into the module card receiving area to physically and electrically contact the module card, the first contacts extending through the base surface of the housing to electrically connect the module card to the circuit board; and second electrical contacts mounted in the housing and extending into the module card receiving area and the operating circuit card receiving area to physically and electrically contact the module card and the operating circuit card.

11. The electrical connector of claim 10, wherein a second module card is receivable in a second module card receiving area adjacent the operating circuit card receiving area.

12. The electrical connector of claim 11, wherein third electrical contacts are mounted in the housing which extend into the second module card receiving area and the operating circuit card receiving area to physically and electrically contact the second module card and the operating circuit card.

13. The electrical connector of claim 12, wherein fourth electrical contacts are mounted in the housing which extend into the second module card receiving area and electrically and physically contact the second module card and which extend through the base of the housing to attach to the circuit board.

* * * * *